US005158029A

United States Patent [19]

Hirose

[11] Patent Number: 5,158,029

[45] Date of Patent: Oct. 27, 1992

[54] ROTARY HOOK FOR SEWING MACHINES

[75] Inventor: Tokuzo Hirose, Hyogo, Japan

[73] Assignee: Hirose Manufacturing Company, Limited, Osaka, Japan

[21] Appl. No.: 629,552

[22] Filed: Dec. 18, 1990

[51] Int. Cl.[5] ..... D05B 57/08

[52] U.S. Cl. ..... 112/230

[58] Field of Search ..... 112/228, 230, 229, 231, 112/184, 181

[56] References Cited

U.S. PATENT DOCUMENTS

| | | | |
|---|---|---|---|
| 1,431,380 | 10/1922 | Dickson | 112/228 |
| 1,863,077 | 6/1932 | Walterman | 112/230 |
| 2,491,022 | 12/1949 | Abresky | 112/228 |
| 2,941,488 | 6/1960 | Attwood | 112/228 |
| 3,140,681 | 7/1964 | Corey | 112/228 |
| 3,223,060 | 12/1965 | Corey | 112/228 |
| 3,658,021 | 4/1972 | Hedegaard et al. | 112/292 |
| 4,488,499 | 12/1984 | Giaimo et al. | 112/230 |
| 4,493,278 | 1/1985 | Badillo | 112/230 X |
| 4,638,750 | 1/1987 | Mikuni | 112/230 |
| 4,660,487 | 4/1987 | Mikuni | 112/230 |
| 4,662,292 | 5/1987 | Koike et al. | 112/230 X |
| 4,674,423 | 6/1987 | Koike et al. | 112/230 X |
| 4,966,088 | 10/1990 | Badillo | 112/230 X |

FOREIGN PATENT DOCUMENTS

| | | | |
|---|---|---|---|
| 90544 | 10/1983 | European Pat. Off. | 112/230 |
| 933601 | 9/1955 | Fed. Rep. of Germany | 112/230 |
| 1941681 | 6/1971 | Fed. Rep. of Germany . | |

OTHER PUBLICATIONS

Union Special Lockstitch Formation Type 301 Booklet, cover page and p. 5, copyright 1980 Union Special Corp.

*Primary Examiner*—Werner H. Schroeder
*Assistant Examiner*—Paul C. Lewis
*Attorney, Agent, or Firm*—Wenderoth, Lind & Ponack

[57] ABSTRACT

A front section of a hook point member, relative to a rotating direction, of a rotating hook assembly is replaceable. The member can be replaced with a new one when a hook point is worn. Also, the replaceable member is made of a material of high hardness, such that burr-like edges will not be formed, thereby making it possible to obtain good sewing performance for a long period of time. The hook point and a claw may be formed integrally and can be replaced when the hook point and/or the claw is worn.

15 Claims, 5 Drawing Sheets

ROTARY HOOK FOR SEWING MACHINES

BACKGROUND OF THE INVENTION

1. Field of the invention

The present invention relates to a rotary hook assembly for sewing machines and more particularly, to a rotary hook assembly of a sewing machine where a hook point or hook point member thereof is changeable.

2. Description of prior art

FIG. 1 shows a perspective view of a horizontal axis rotating hook assembly 1 typical in the prior art. Reference is made to FIG. 1 in the following explanation of such prior art assembly. A rotating hook body 2 formed generally in the shape of a bottomed cylinder has an opening *2a* which is cut in a portion of a side wall thereof and defines an integral hook point 3. Fixed on the outer periphery of the rotating hook body 2 is a gib 4 for preventing a bobbin case holder (not shown) installed in the rotating hook body 2 from detaching therefrom. The gib 4 is provided with a gib claw 5 at a position opposing the hook point 3. In such known rotating hook assembly 1 constructed as described above, undesirable contact and rubbing of a needle against the hook point 3 during a sewing operation causes the needle and the hook point 3 to wear. Wear of the hook point 3 may prevent it from taking up needle thread loops, thereby resulting in missed stitches.

Also, collisions between the hook point 3 and the needle sometimes cause burr-like edges to form on the hook point 3, thus resulting in the disadvantage that the thread may be damaged by contact with such rising edges.

Moreover, since the hook point 3 is formed integrally with the rotating hook body 2, even when the gib 4 is removed from the rotating hook body 2, a space W1 between the hook point 3 which is one end of the opening *2a* of the rotating hook body 2 and the opposite end of the opening is very small. Therefore, formation of the hook point 3 requires machining of a high-hardness material in a narrow space with high precision, resulting in poor machinability and problems in productivity.

As described above, the complete rotating hook assembly of a sewing machine of the prior art is not capable of good sewing performance for a long period of time in cases such as sewing thick fabric and sewing while automatically moving an object to be sewn such as cloth, and has poor productivity.

SUMMARY OF THE INVENTION

The object of the invention is to provide a complete rotating hook assembly for a sewing machine which solves the problems described above, makes it possible to improve productivity, and provides improved sewing performance for a long period of time.

The rotating hook assembly of the invention has a changeable hook point member having a tip at a front end thereof, in a rotating direction of the rotating hook assembly, made of a material of high hardness.

In a preferable embodiment of the invention, the hook point member has a shape substantially of a rod or a plate.

In another preferable embodiment of the invention, a mounting seat of a rotating hook body faces forwardly in the rotating direction of the rotating hook assembly.

In a further preferable embodiment of the invention, the hook point member can be installed by means of bolts and is detachable. In another preferable embodiment of the invention, the hook point member can be installed on the rotating hook body by means of welding and is made exchangeable.

The hook point and the gib claw which is located at a rear end of the rotating hook body, in the rotating direction thereof, may be formed integrally with a changeable member made of a material of high hardness and which may be detachably mounted at an end of a cut-out opening in the rotating hook body. In a preferable embodiment of the invention, the changeable member is substantially plate-shaped and a plane formed by the changeable member extends obliquely to and crosses an axial line of the rotating hook assembly.

In accordance with the invention, at least a portion of a hook point member facing in the rotating direction of rotating hook assembly is changeable and therefore easily can be replaced when the hook point has become worn. Also, because the changeable hook point member is made of a material of high hardness, it is not likely to be subject to the problems of wear of the hook point and the formation of burr-like edges as occurs in the prior art, and is therefore capable of providing good sewing performance for a long period of time. Also in accordance to the invention, the hook point and a gib claw may be formed as an integral member which is changeable. Thus, in the case of wear of the hook point and/or the gib claw, the member can be changed, thereby also providing good sewing performance for a long period of time.

In accordance to the invention, as described above, it is possible to replace the hook point member easily with a new member when the hook point is worn or burr-like edges are formed thereon. Also, the hook point is not subject to wear because it is made of a material of high hardness. Consequently, good sewing performance can be maintained for a long period of time. Also, because it is not necessary to form the hook point raceway integrally with the rotating hook body during manufacture of the rotating hook assembly, the necessary machining is simplified and productivity can be improved.

Another object of the invention is to provide a rotating hook assembly which solves the technical problems described above, is capable of sewing with proper sewing performance corresponding to the characteristics of the object to be sewn, such as thickness, and is therefore capable of improving the quality of sewing, while at the same time being capable of simplified manufacture and improved productivity.

In order to achieve the above objects, the rotating hook assembly for a sewing machine of the invention may comprise a hook point member which is made of a material of high hardness and includes a pair of mounting sections respectively defining a hook point and a gib claw spaced by a first distance and a connection section connecting the mounting sections and having a second length greater than the first length.

Formed on the rotating hook body is a mounting seat for mounting the hook point member. The mounting seat may be inclined upwardly and outwardly from a bottom of the rotating hook body. A gib mounted on the rotating hook body may have an end face substantially flush with the mounting seat. The gib claw need not be formed on the gib, so that the construction can be simplified, thus also improving productivity. Also, accuracy of installation is less critical and thus installation and manufacture are easier.

BRIEF DESCRIPTION OF THE DRAWINGS

Other and further objects, features, and advantages of the invention will be apparent from the following detailed description taken with reference to the accompanying drawings, wherein.

DETAILED DESCRIPTION OF THE PREFERRED EMBODIMENTS

Referring now to FIGS. 2-8 of the drawings, preferred embodiments of the invention will be described below.

Figure 1:
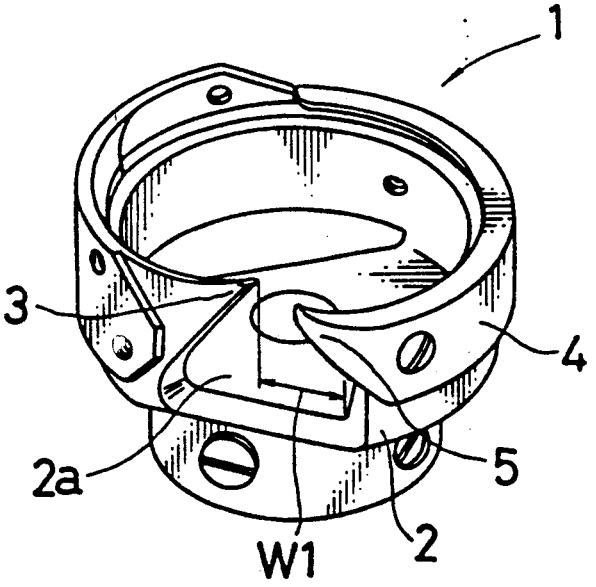
FIG. 1 is a perspective view showing a typical prior art rotating hook assembly.
Figure 2:
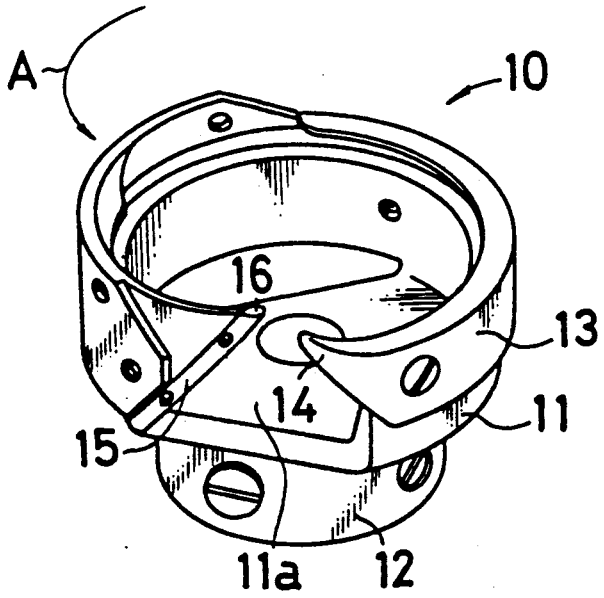
FIG. 2 is a perspective view showing a rotating hook assembly of one embodiment of the invention.
Figure 3:
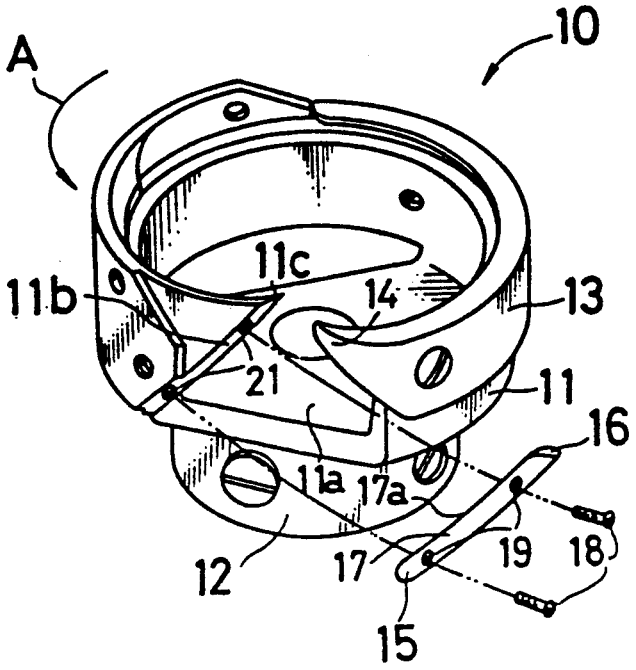
FIG. 3 is an exploded perspective view showing the rotating hook assembly of FIG. 2.
Figure 4:
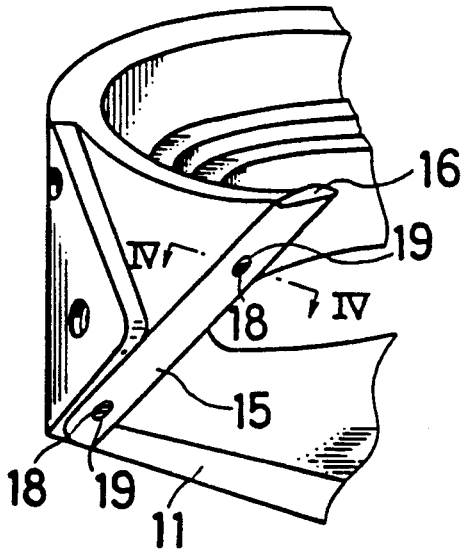
FIG. 4 is an enlarged perspective view showing an area adjacent a hook point member of the rotating hook assembly.
Figure 5:
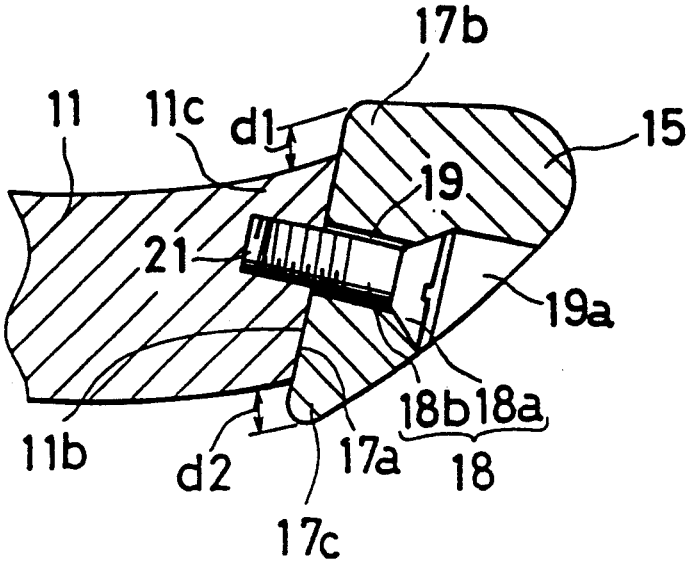
FIG. 5 is a cross-sectional view taken along line V—V of FIG. 4.

FIG. 2 is a perspective view of a rotating hook assembly 10 explanatory of the basic concept of the invention. FIG. 3 is an exploded perspective view of the rotation hook assembly 10. FIG. 4 is an enlarged illustration of an area adjacent a hook point member 15 mounting seat of the rotating hook assembly 10. FIG. 5 is a cross-sectional view along line V—V of FIG. 4. Reference to FIGS. 2-5 will be made in the following explanation of the structure of the rotating hook assembly 10. A rotating hook body 11 of the rotating hook assembly 10 is formed generally in the shape of a bottomed cylinder, similar to the prior art rotating hook body 2 described above, and is provided with a mounting section 12 which is to be connected to a lower shaft (not shown) connected to a drive shaft of a drive mechanism. The rotating hook assembly 10 is driven in this manner to rotate around an axis of the shaft in the direction of an arrow A. A bobbin case holder (not shown) is to be mounted in the inner surface of the rotating hook body 11 to be mutually rotatable therewith around the axis, and is prevented from being removed therefrom by a gib 13 provided with a gib claw 14.

The rotating hook body 11 has a cut-out opening 11*a* at a part of a side wall thereof. Mounted detachably on an upstream end of the side wall, relative to the rotating direction A, defined by the cut-out opening 11*a* is a hook point member 15 which roughly is in the shape of a rod. The hook point member 15 includes a hook point 16 and a mounting section 17. The hook point 16 is formed at an end of the hook point member 15. The mounting section 17 is provided with a plurality (two in this embodiment) of insertion holes 19 through which are passed shafts of bolts 18 to fix the hook point member 15 on the rotating hook body 11. Recesses 19*a* are formed concentrically with the insertion holes 19, and heads 18*a* of the bolts 18 fit into the recesses 19*a*.

Figure 6:
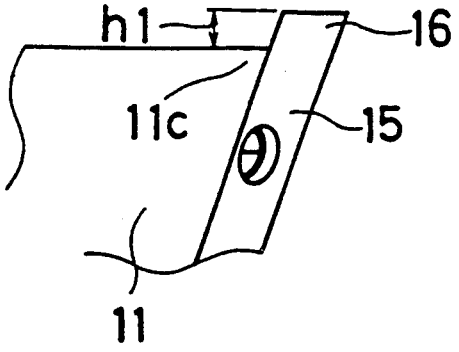
FIG. 6 is an enlarged partial elevation showing the positional relationship of the hook point member with respect to a rotating hook body.

Provided in a mounting face 11*b* of the rotating hook body 11 are screw holes 21 for receipt of the bolts 18. Holes 21 are positioned to align with insertion holes 19 in the mounting section 17 of the member 15. The shafts 18*b* of the bolts 18 pass through the insertion holes 19 and screw into the screw holes 21 in the mounting face 11*b* of the rotating hook body 11, thereby determining the position of the member 15 on the rotating hook body 11. When the member 15 is fixed on the rotating hook body 11 by the bolts 18, radially outer and inner edges of the member 15 are disposed to project outwardly and inwardly by lengths d1 and d2, respectively, in radial directions, of downstream end 11*c* of the rotating hook body 11, relative to the rotating direction A. Also, the member 15 is arranged at the end 11*c* so that the hook point 16 projects from the top face of the end 11*c* by distance h1, as shown in FIG. 6. In this construction, an upper thread loop invariably will contact the member 15 even when member 15 is displaced relative to the rotating hook body 11, and such thread loop will not contact the end 11*c* of the rotating hook body 11, thereby preventing undesirable wear of the rotating hook body 11 adjacent the end 11*c*.

Sections or corners 17*b*, 17*c* of the member 15, where a mounting face 17*a* and sides thereof meet longitudinally, are curved or arc-shaped. This construction prevents a needle thread from being caught at the corners 17*b*, 17*c* and broken when the hook point 15 catches a needle thread loop and the needle thread returns.

Figure 7:
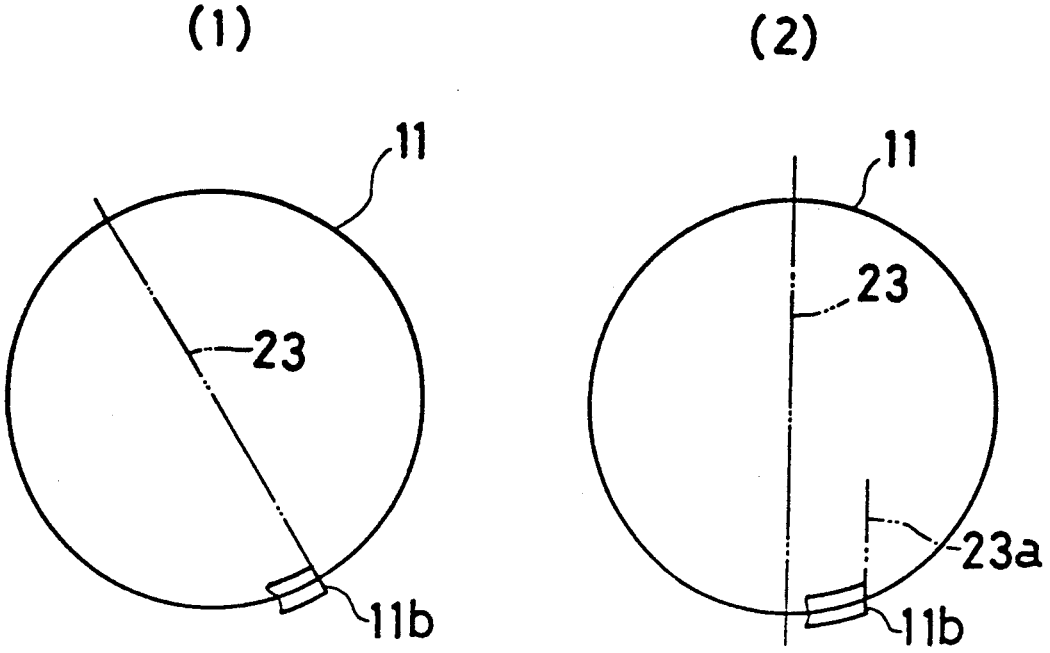
FIGS. 7(1) and 7(2) are schematic illustrations showing orientations of a mounting face of the rotating hook body.

FIGS. 7(1) and 7(2) illustrate orientations of the mounting face 11*b* of the rotating hook body 11. Thus, the mounting face 11*b* may be provided along an imaginary plane 23 extending radially or diametrally of the rotating hook body 11 and containing the rotational axis thereof, as shown in FIG. 7(1), or may be provided along an imaginary plane 23*a* parallel to an imaginary plane 23 extending radially or diametrally of body 11 and containing the rotational axis thereof, as shown in FIG. 7(2).

The rotating hook body 11 is made of a hardened metal such as steel, for example. The hook point member 15 is made of a hardened steel or high grade steel, or of sintered metal or ceramics including a material of high hardness which is difficult to cut. The member 15 also may be formed on the surface thereof with hardened chrome or titanium nitride (TiN).

By a construction such as described above, the member 15 can be attached and detached freely by means of the bolts 18, thereby making it possible to replace the member 15 easily when the hook point 16 undesirably has contacted the needle during a sewing operation and consequently has become worn. Therefore, even when it has become impossible for the hook point to pick up needle thread loops due to wear of the hook point, as described above relative to the prior art and resulting in missing stitches, good sewing performance can be recovered by replacing the member 15.

Moreover, because the member 15 is made of a hardened steel or high grade steel or sintered metal, or is formed on the surface thereof with hardened chrome or titanium nitride, it is resistant to wear and to the formation of burr-like edges generated by the collision of the hook point and the needle. Therefore, the thread is prevented from being damaged or broken by such burr-like edges. Consequently, good sewing performance can be maintained for a long period of time.

In another embodiment of the invention, it is made possible to sew fabrics of multiple thicknesses with a single rotating hook assembly, by providing a plurality of members 15, to be fixed to the rotating hook body 11, of different shapes and changing them as necessary. The member 15 is formed in roughly an elongated plate shape, and the hook point may be provided on one end thereof in the longitudinal direction.

Figure 8:
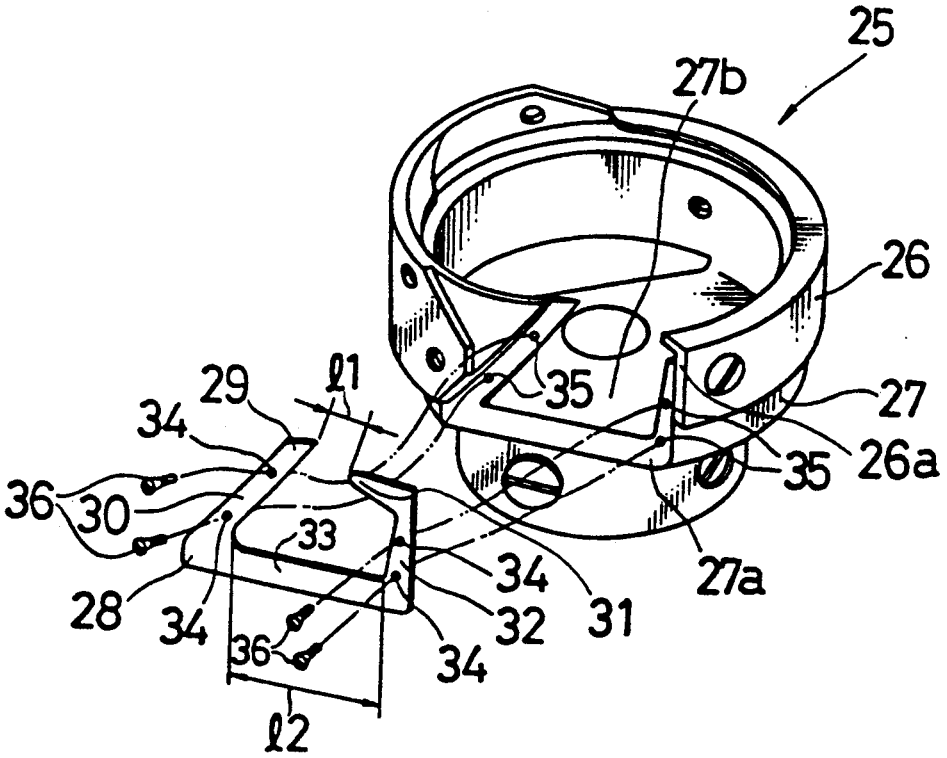
FIG. 8 is an exploded perspective view showing a rotating hook assembly of another embodiment of the invention.

FIG. 8 is an exploded perspective view of a rotating hook assembly 25 of another embodiment of the invention. Also in this embodiment, as in the case of the previous embodiment, a hook point member 28 of roughly elongated plate shape is mounted detachably on a body 27. The detachable member 15 in the embodiment previously described has formed thereon the hook point 16, and the gib 13 has formed thereon the gib claw 14. In this embodiment, the gib 26 only prevents removal of the bobbin case holder (not shown) which is mounted in the rotating hook body 27 and has no gib claw.

The hook point member 28 includes mounting sections 30, 32 which have a plurality of insertion holes 34 for passage therethrough of the shafts of bolts 36. The mounting sections 30, 32 are connected by a connecting section 33 of length l2 thereby to form an integral body. The free end of the mounting section 30 is formed into a hook point 29, and the free end of the mounting section 32 is formed into a claw 31. The hook point 29 and the claw 31 are separated by a space or length l1 which is shorter than the length l2 of the connection section 33 ($l2 > l1$).

The rotating hook body 27 has a cut-out opening at a part of the side wall thereof, and the cut-out opening has a mounting face 27*a*. The mounting face 27*a* is inclined outwardly and upwardly from a bottom 27*b* of the rotating hook body 27. Provided in the mounting face 27*a* of the rotating hook body 27, at positions corresponding to the insertion holes 34 of the member 28 are a plurality of screw holes 35. The mounting face 27*a* and an end face 26*a* at one circumferential end of the gib 26 mounted on the rotating hook body 27 are disposed substantially in the same plane, and it is unnecessary to form a claw on the gib 26, thereby making it possible to simplify construction and improve productivity.

The length or space l1 is set to about 2.5 mm when the fabrics to be sewn are of thin to medium thickness, for example, and about 8.5 mm in the case of thick fabrics. However, dimension l1 is not limited to such values, and good sewing performance can be obtained for various fabric thicknesses by preparing a plurality of members 28 of various types and by properly exchanging them.

The member 28 in the embodiment described above may be made of hardened steel or high grade steel, or may be a sintered metal or ceramics formed on the surface thereof with hardened chrome or titanium nitride (TiN), similar to the member 15 of the first embodiment.

While the members 15 and 28 of the preceding embodiments are mounted detachably on the rotating hook bodies 11 and 27 by means of bolts, they may be fixed by welding and made replaceable.

The invention can be applied to a vertical axis full rotating hook, a horizontal axis full rotating hook and an oscillating hook.

The invention may be embodied in other specific forms without departing from the spirit or essential characteristics thereof. The present embodiments are therefore to be considered in all respects as illustrative and not restrictive, the scope of the invention being indicated by the appended claims rather by the foregoing description, and all changes which come within the meaning and the range of equivalency of the claims are therefore intended to be embraced therein.

What is claimed is:

1. In a rotating hook assembly including a rotating hook body to be rotated about an axis of rotation in a direction of rotation, said rotating hook body including a cylindrical wall coaxial with said axis, said wall having formed therein a cut-out opening, and a hook point at said opening and facing in said direction, the improvement comprising:

said opening being at least partially defined by a planar surface of said rotating hook body;

a hook point member having a planar surface and an end defining said hook point and being formed of a material of high hardness;

said hook point member being detachably mounted on said rotating hook body with said planar surfaces in mating abutment and with said hook point defining end facing in said direction and extending axially beyond a free axial end of said rotating hook body; and said hook point member having longitudinally extending outer and inner edges that project radially outwardly and inwardly, respectively, of outer and inner surfaces of said cylindrical wall of said rotating hook body, said outer and inner edges being curved.

2. The improvement claimed in claim 1, wherein said planar surfaces are inclined relative to said axis.

3. The improvement claimed in claim 1, wherein said member is rod-shaped.

4. The improvement claimed in claim 3, wherein said planar surface of said rotating hook body defines an upstream edge of said opening relative to said direction, and said member is mounted on said upstream edge.

5. The improvement claimed in claim 4, wherein said member is mounted by bolts extending through said member and threaded into said edge.

6. The improvement claimed in claim 1, wherein said member is plate-shaped.

7. The improvement claimed in claim 6, wherein said planar surface of said rotating hook body extends in an inclined outward direction from a base of said rotating hook body to said free axial end thereof, and said planar surface of said rotating hook body entirely defines said opening.

8. The improvement claimed in claim 6, wherein said planar surface of said rotating hook body defines upstream and downstream edges of said opening, relative to said direction, and an axial bottom edge of said opening.

9. The improvement claimed in claim 8, wherein said plate-shaped member includes a pair of mounting sections joined by a connection section.

10. The improvement claimed in claim 9, wherein said mounting sections are mounted on said upstream and downstream edges of said opening, and said connecting section is mounted on said bottom edge of said opening.

11. The improvement claimed in claim 10, wherein said mounting sections are mounted by bolts extending through said mounting sections and threaded into said upstream and downstream edges.

12. The improvement claimed in claim 9, wherein said first said mounting section has at a free end thereof said hook point.

13. The improvement claimed in claim 12, wherein a second said mounting section has formed at a free end thereof a claw directed toward said hook point and spaced therefrom by a first length.

14. The improvement claimed in claim 13, wherein said connecting section has a second length greater than said first length.

15. The improvement claimed in claim 6, further comprising a gib mounted on said rotating hook body and having an end surface facing said opening, said end surface extending substantially coplanar with said planar surface of said rotating hook body.

* * * * *